US010228155B2

(12) United States Patent
Harman

(10) Patent No.: US 10,228,155 B2
(45) Date of Patent: Mar. 12, 2019

(54) DUCT PLUG FOR A DUCT TERMINATION OPENING

(71) Applicant: Rodney James Harman, Whistler (CA)

(72) Inventor: Rodney James Harman, Whistler (CA)

( * ) Notice: Subject to any disclaimer, the term of this patent is extended or adjusted under 35 U.S.C. 154(b) by 0 days.

(21) Appl. No.: 14/434,074

(22) PCT Filed: Oct. 9, 2013

(86) PCT No.: PCT/CA2013/050762

§ 371 (c)(1),
(2) Date: Apr. 7, 2015

(87) PCT Pub. No.: WO2014/056106

PCT Pub. Date: Apr. 17, 2014

(65) Prior Publication Data

US 2015/0276260 A1 Oct. 1, 2015

Related U.S. Application Data

(60) Provisional application No. 61/795,051, filed on Oct. 9, 2012.

(51) Int. Cl.
*F24F 13/20* (2006.01)
*F24F 13/08* (2006.01)

(52) U.S. Cl.
CPC ..... *F24F 13/20* (2013.01); *F24F 13/08* (2013.01); *F24F 13/085* (2013.01)

(58) Field of Classification Search
CPC .... F24F 13/28; F24F 13/085; B01D 46/0005; B01D 46/2414; F16L 55/1141
USPC ..... 138/89.1, 89
See application file for complete search history.

(56) References Cited

U.S. PATENT DOCUMENTS 2,245,887 A * 6/1941 Wikander ..... F16L 55/132 138/89
3,046,719 A 7/1962 Tropiano
4,964,438 A * 10/1990 Welty ..... F16L 55/11 126/319
5,363,881 A * 11/1994 Larkin ..... F16L 55/132 138/89
5,472,380 A 12/1995 Sarazen, Jr. et al.
(Continued)

FOREIGN PATENT DOCUMENTS

CA 2261685 4/1998
CA 2370550 8/2002
(Continued)

OTHER PUBLICATIONS

WIPO, International Searching Authority, "International Search Report" dated Dec. 20, 2013 in International Patent Application No. PCT/CA2013/050762, 4 pages.
(Continued)

*Primary Examiner* — Craig Schneider
*Assistant Examiner* — David Deal
(74) *Attorney, Agent, or Firm* — Cameron IP

(57) ABSTRACT

A duct plug for use with a duct opening of a heating, ventilation or air conditioning duct system comprises a first frame member, a second frame member, and a filter member disposed between the first frame member and the second frame member. The first frame member is releasably coupled to the second frame member.

8 Claims, 10 Drawing Sheets

(56) References Cited

U.S. PATENT DOCUMENTS

| | | | | |
|---|---|---|---|---|
| 6,419,104 | B1 * | 7/2002 | Sarajian | B05B 15/0462 215/358 |
| 6,461,235 | B2 | 10/2002 | Rutler et al. | |
| 6,575,827 | B1 | 6/2003 | Rutler et al. | |
| 6,749,499 | B1 | 6/2004 | Snyder | |
| 6,817,942 | B1 | 11/2004 | Betz | |
| 6,824,356 | B2 * | 11/2004 | Nolfi | F02C 7/00 29/889.21 |
| 6,874,541 | B2 | 4/2005 | Vossen | |
| 7,533,698 | B2 * | 5/2009 | Nolfi | F02C 7/00 138/104 |
| 7,811,346 | B1 * | 10/2010 | Henson | B01D 46/0005 200/61.51 |
| 2006/0094348 | A1 | 5/2006 | Berger | |
| 2007/0123161 | A1 | 5/2007 | Pilger | |

FOREIGN PATENT DOCUMENTS

| | | |
|---|---|---|
| CA | 2524874 | 4/2006 |
| CA | 2611074 | 5/2008 |

OTHER PUBLICATIONS

WIPO, International Searching Authority, "Written Opinion of the International Searching Authority" dated Dec. 20, 2013 in International Patent Application No. PCT/CA2013/050762, 6 pages.

Pro-Tec-Vent Ltd., "ProTec Vent Filters Construction Vents Product Canada", printed Feb. 8, 2013, http://protecvent.com/Products.aspx.

Production Products, Inc., "PROFAB On/Off Duct Covers | Production Products, Inc.", printed Feb. 11, 2013, http://www.ppiduct.com/catalog/hvac_supplies/profab_onoff_duct_covers.html.

NAHB Research Center, "Duct Boot, Hanger, & Debris Cover All in One", printed Feb. 11, 2013, http://www.toolbase.org/Technology-Inventory/HVAC/speedi-boot.

Ductcap Products, Inc., "Welcome to Ductcap", printed Sep. 2, 2013, http://www.ductcap.com/.

Smith Slip, "Smith Slip", printed Sep. 2, 2013, http://www.smithslips.com.

Pro-Tec-Vent Ltd., "Home Builders Vent Cleaning Open Vent Protection ProTec Vent Canada", printed Feb. 24, 2013, http://www.protecvent.com/Benefits/BenefitsforHomeBuilders.aspx.

Canadian Intellectual Property Office, Office Action dated Apr. 21, 2016, 5 pages.

* cited by examiner

DUCT PLUG FOR A DUCT TERMINATION OPENING

BACKGROUND OF THE INVENTION

Field of the Invention

The present invention relates to a duct plug and, in particular, to a duct plug for use with a duct termination opening of a heating, ventilation or air conditioning duct system to inhibit dust and debris from entering the duct system.

Description of the Related Art

It is known to use a vent opening cover to prevent debris from entering a vent opening. U.S. Pat. No. 6,461,235, which issued on Oct. 8, 2002 to Rutler et al., discloses a temporary vent opening cover which is securable over a vent opening in a floor or other surface during building construction to prevent debris from entering the vent opening and accumulating in duct work associated therewith. The cover includes a generally flat cover plate which is sized and shaped to cover the vent opening. The cover plate is spaced outwardly from the surface when the vent opening cover is secured over the vent opening. A plurality of air passages allow air to flow past the cover plate between the duct work and a workspace. A layer of air filter material covers the air passages and prevents debris from passing therethrough.

SUMMARY OF THE INVENTION

It is an object of the present invention to provide an improved duct plug for use with a duct termination opening of a heating, ventilation or air conditioning duct system.

There is accordingly provided a duct plug for use with a duct opening of a heating, ventilation or air conditioning duct system. The duct plug comprises a first frame member, a second frame member, and a filter member disposed between the first frame member and the second frame member. The first frame member is releasably coupled to the second frame member.

The filter member may extend outwardly beyond at least one of the frame members. The first frame member may be releasably coupled to the second frame member by a fastener which extends through the filter member. The fastener may include a shaft extending from the first frame member. The shaft may extend through a filter aperture in the filter member. The shaft may be received by a frame aperture in the second frame member. The first frame member and the second frame member may each include an annular plate with a central opening. The filter member may be disc-shaped. The first frame member, the second frame member and the filter member may be rectangular. There may be a handle extending from at least one of the frame members. There may be a plurality of circumferentially spaced-apart teeth extending from at least one of the frame members and into the filter member. The filter member may be an air-permeable plastic foam. There may be a cover plate shaped to cover the duct opening when the duct plug is received within the duct opening.

There is also provided a duct plug for use with a duct opening of a heating, ventilation or air conditioning duct system. The duct plug comprises a first frame member, a second frame member, and a filter member disposed between the first frame member and the second frame member. The filter member extends outwardly beyond at least one of the frame members. The first frame member includes a shaft extending through a filter aperture in the filter member. The shaft is received by a frame aperture in the second frame member to releasably couple the first frame member to the second frame member.

There may be a cover plate shaped to cover the duct opening when the duct plug is received within the duct opening. The first frame member, the second frame member, the filter member and the cover plate may be rectangular. The cover plate may include a plurality of adjustable walls on an underside thereof. The adjustable walls may have corresponding outer faces which form an inner perimeter of the cover plate. The outer faces of the adjustable walls may be in frictional engagement with interior duct walls of the duct system. The adjustable walls may be slidable stepwise along an axis of the cover plate by abutting against detents extending from the underside of the cover plate. The cover plate may include indicia to indicate a size of the inner perimeter achieved by sliding the adjustable walls stepwise.

There is further provided a cover plate for use with a duct opening of a heating, ventilation or air conditioning duct system. The duct opening is defined by interior duct walls. The cover plate comprises a plurality of adjustable walls on an underside thereof. The adjustable walls have corresponding outer faces which are in frictional engagement with the interior duct walls. There is a plurality of detents extending from the underside of the cover plate. The adjustable walls are slidable stepwise along an axis of the cover plate by abutting against the detents.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
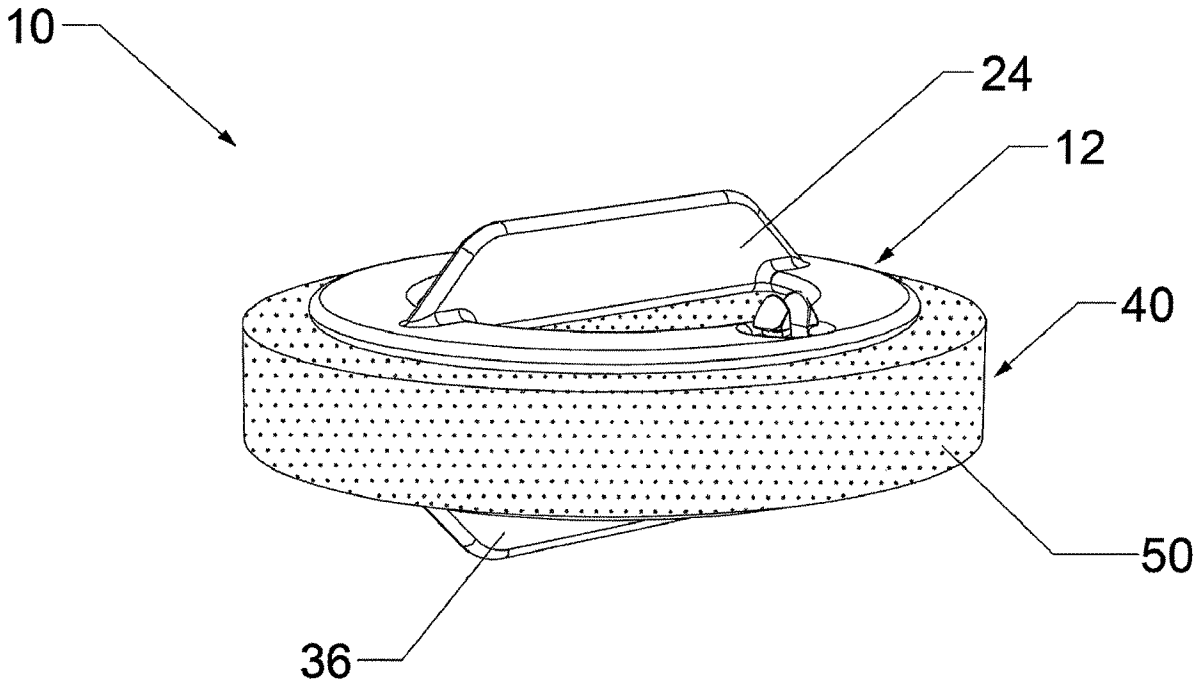
FIG. 1 is a perspective view of a first embodiment of an improved duct plug.
Figure 2:
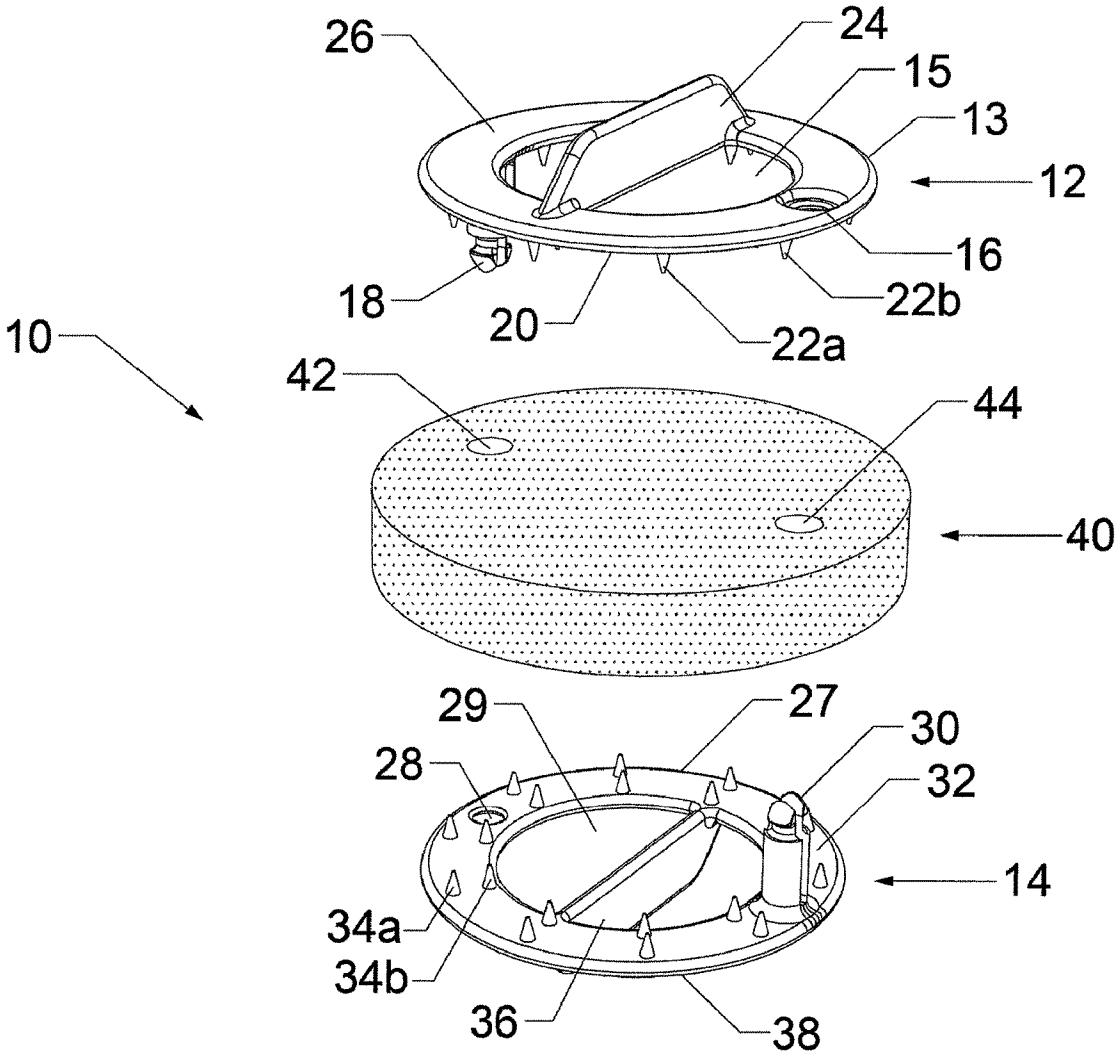
FIG. 2 is an exploded view of the duct plug of FIG. 1.

Referring to the drawings and first to FIG. 1, there is shown a first embodiment of an improved duct plug 10. As best shown in FIG. 2, the duct plug 10 comprises a first frame member 12, a second frame member 14 and a filter member 40. The first frame member 12 includes an annular plate 13 with a central opening 15 in this example but may be other shapes. There is a frame aperture 16 extending through the annular plate 13. There is a frame shaft 18 extending from an inner face 20 of the annular plate 13. The frame shaft 18 is a bifurcated pin in this example but may be other shapes. There is a plurality of circumferentially spaced-apart teeth, for example, teeth 22*a* and 22*b*, extending from the inner face 20 of the annular plate 13. A handle 24 extends substantially perpendicular from an outer face 26 of the annular plate 13 across the opening 15. The handle 24 has an isosceles trapezoid profile in this example but may be other shapes.

The second frame member 14 is substantially the same as the first frame member 12. The second frame member 14 includes an annular plate 27 with a central opening 29 in this example but may be other shapes. There is a frame aperture 28 extending through the annular plate 27. There is a frame shaft 30 extending from an inner face 32 of the annular plate 27. The frame shaft 30 is a bifurcated pin in this example but may be other shapes. There is a plurality of circumferentially spaced-apart teeth, for example, teeth 34*a* and 34*b*, extending from the inner face 32 of the annular plate 27. A handle 36 extends substantially perpendicular from an outer face 38 of the annular plate 27 across the opening 29. The handle 36 has an isosceles trapezoid profile in this example but may be other shapes.

The filter member 40 is disposed between the inner face 20 of the annular plate 13 of the first frame member 12 and the inner face 32 of the annular plate 27 of the second frame member 14. In this example, the filter member 40 is disc-shaped and is formed of an air-permeable plastic foam but may be other shapes and formed of any suitable material. The filter member 40 includes filter apertures 42 and 44. The filter apertures 42 and 44 are sized and spaced-apart so that the frame shaft 18 of the first frame member 12 extends through the filter aperture 42 and the frame shaft 30 of the second frame member 14 extends through the filter aperture 44. The frame aperture 28 of the second frame member 14 receives the frame shaft 18 of the first frame member 12 and the frame aperture 16 of the first frame member 12 receives the frame shaft 30 of the second frame member 14 to releasably couple the first frame member 12 to the second frame member 14 with the filter member 40 in between. The frame shafts and the frame apertures accordingly together function as fasteners to releasably couple the frame members. The teeth 22*a* and 22*b* of the first frame member 12 and the teeth 34*a* and 34*b* of the second frame member 14 engage the filter member 40 to hold the filter member 40 in place between the first frame member 12 and the second frame member 14. The teeth accordingly function to releasably couple the frame members to the filter member.

Figure 3:
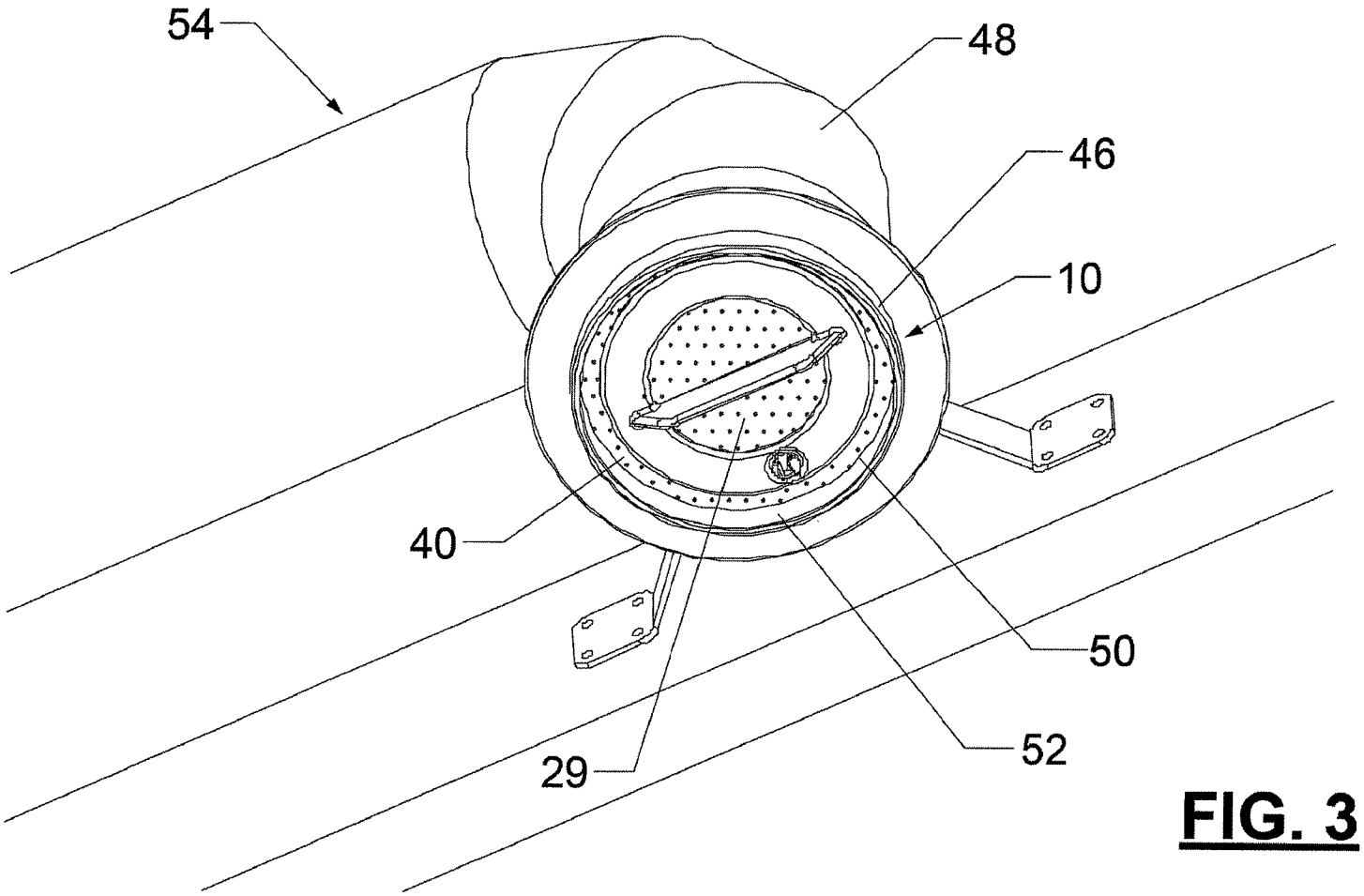
FIG. 3 is a perspective view of the duct plug of FIG. 1 shown in use with a circular duct termination opening.

Referring now to FIG. 3, the duct plug 10 is shown in use with a circular termination opening 46 of, for example, a ventilation duct 48 in a ceiling application. The duct plug 10 is received within the termination opening 46 of the duct 48. A perimeter 50 of the filter member 40, which is generally greater than a perimeter of the first frame member 12 or the second frame member 14, is sized to frictionally engage an interior 52 of the termination opening 46 to hold the filter member 40 in place within the termination opening 46. The filter member 40 may be of different sizes to accommodate different sized duct termination openings. When the duct plug 10 is received within the termination opening 46, the filter member 40 inhibits dust and other particulates from entering a duct system 54 of the duct 48. However, air from the duct system 54 is allowed to pass through the filter member 40 via the opening 15 in the first frame member 12 and the opening 29 in the second frame member 14. Alternatively, a member formed of a non-permeable material may be used in place of the filter member 40 to inhibit air from the duct system 54 from flowing into a building space as well as particulates from flowing into the duct system 54.

Figure 4:
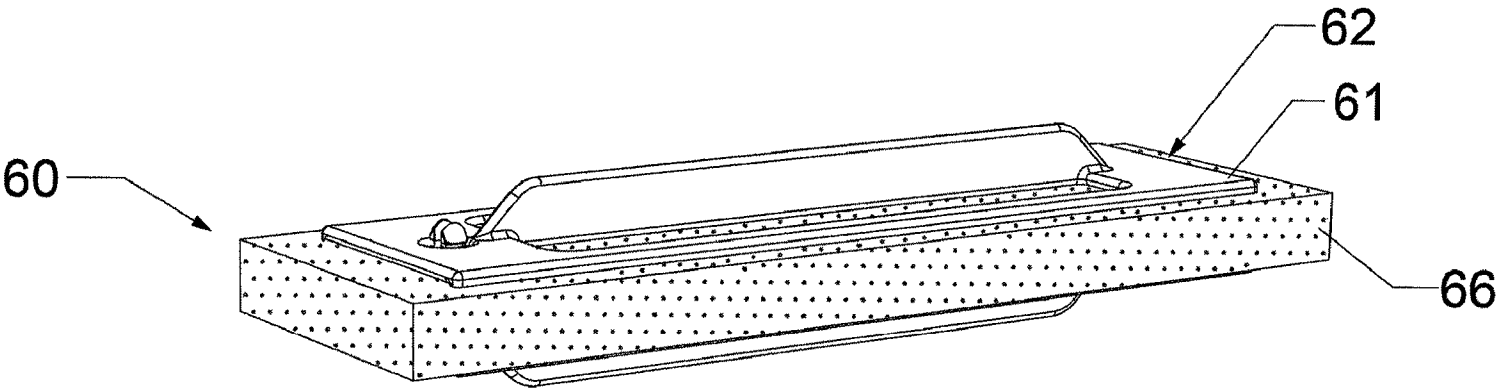
FIG. 4 is a perspective view of a second embodiment of an improved duct plug.
Figure 5:
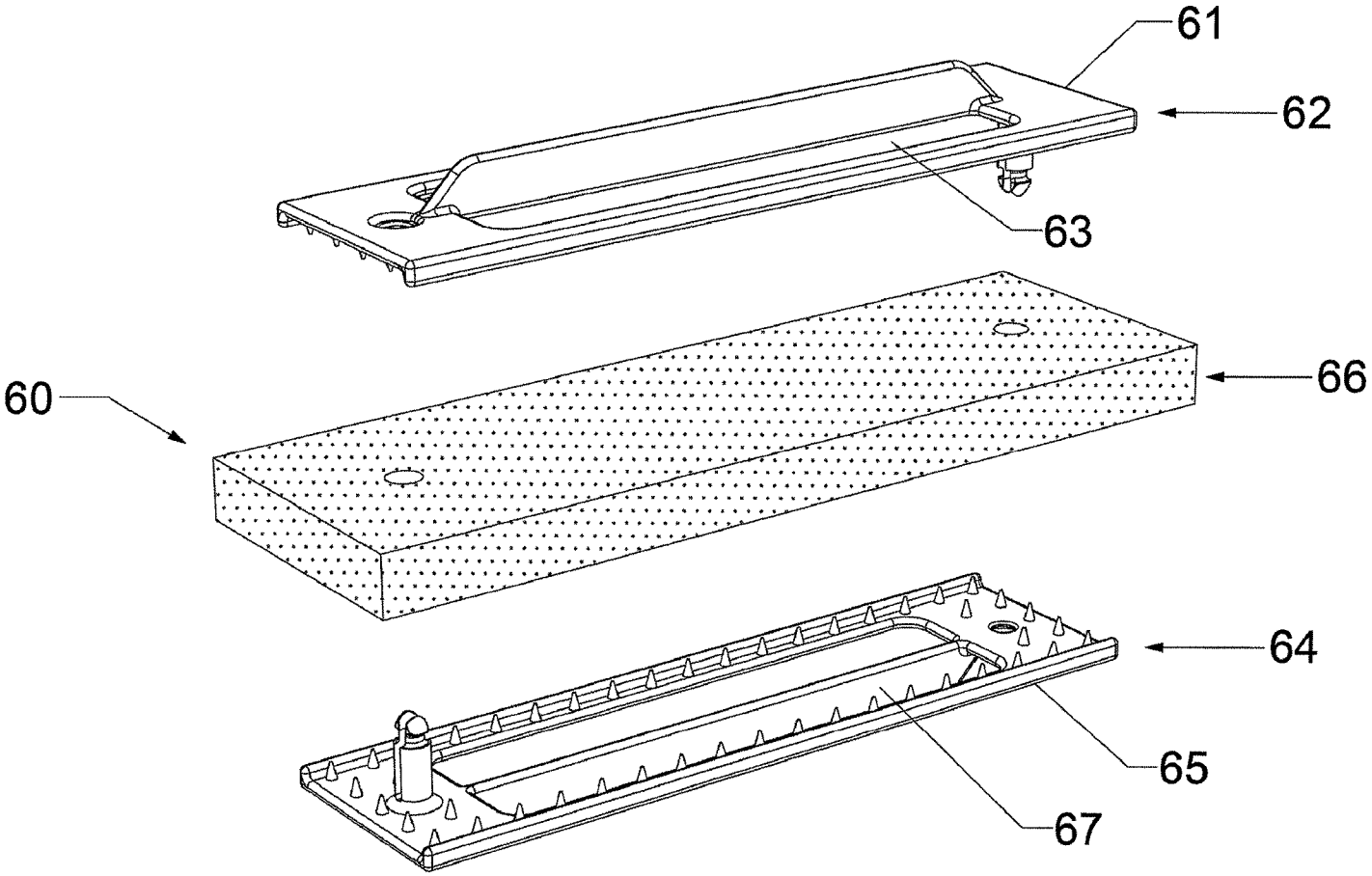
FIG. 5 is an exploded view of the duct plug of FIG. 4.
Figure 6:
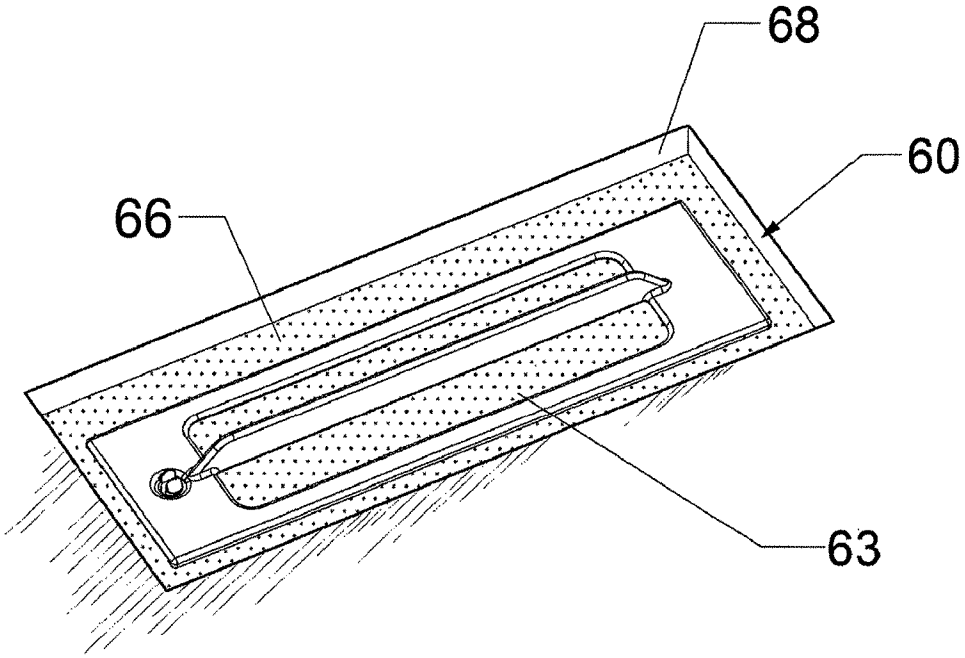
FIG. 6 is a perspective view of the duct plug of FIG. 4 shown in use with a rectangular duct termination opening.
Figure 7:
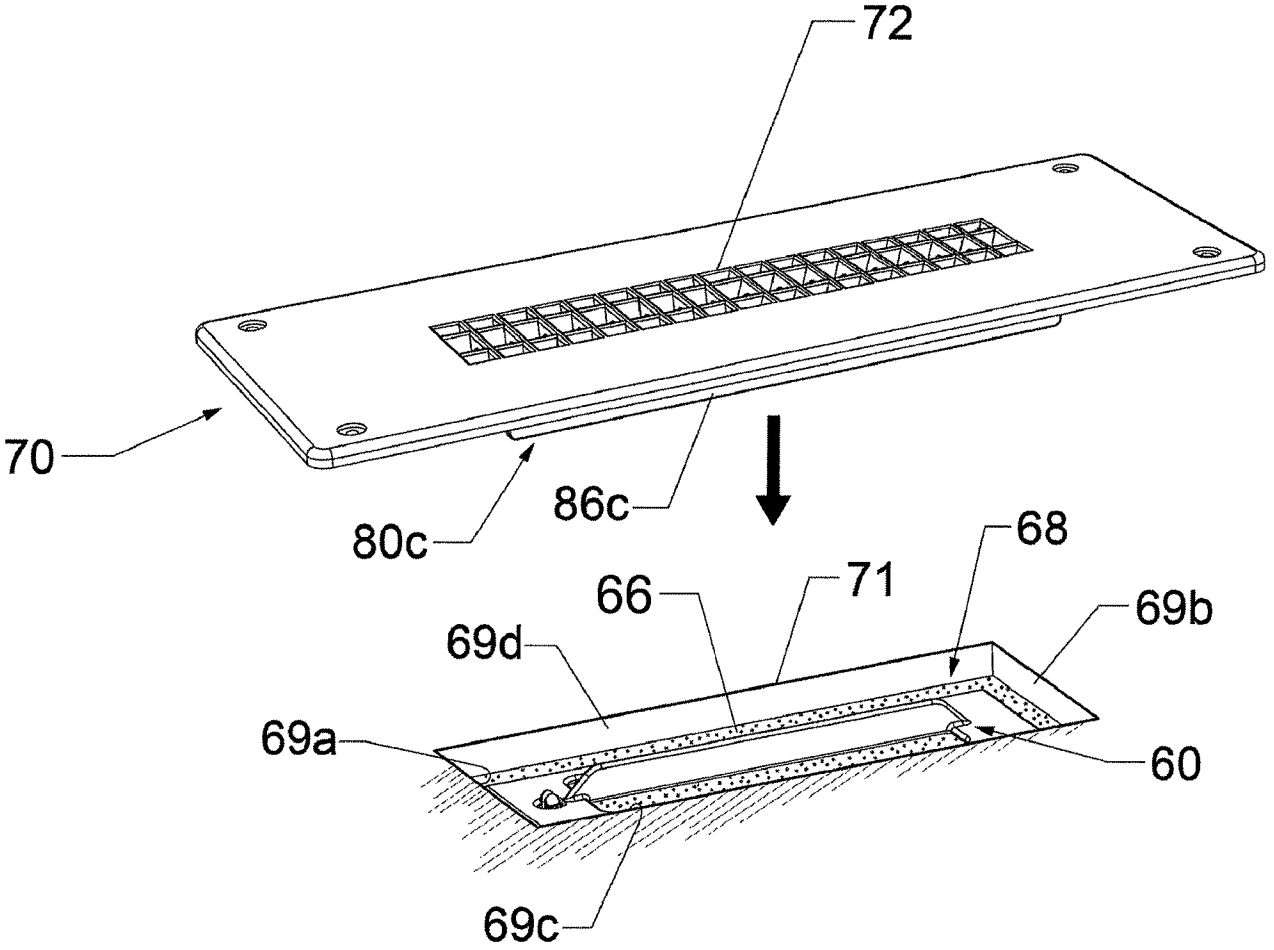
FIG. 7 is a perspective view of a cover plate positioned over the duct plug and duct termination opening of FIG. 6.
Figure 8:
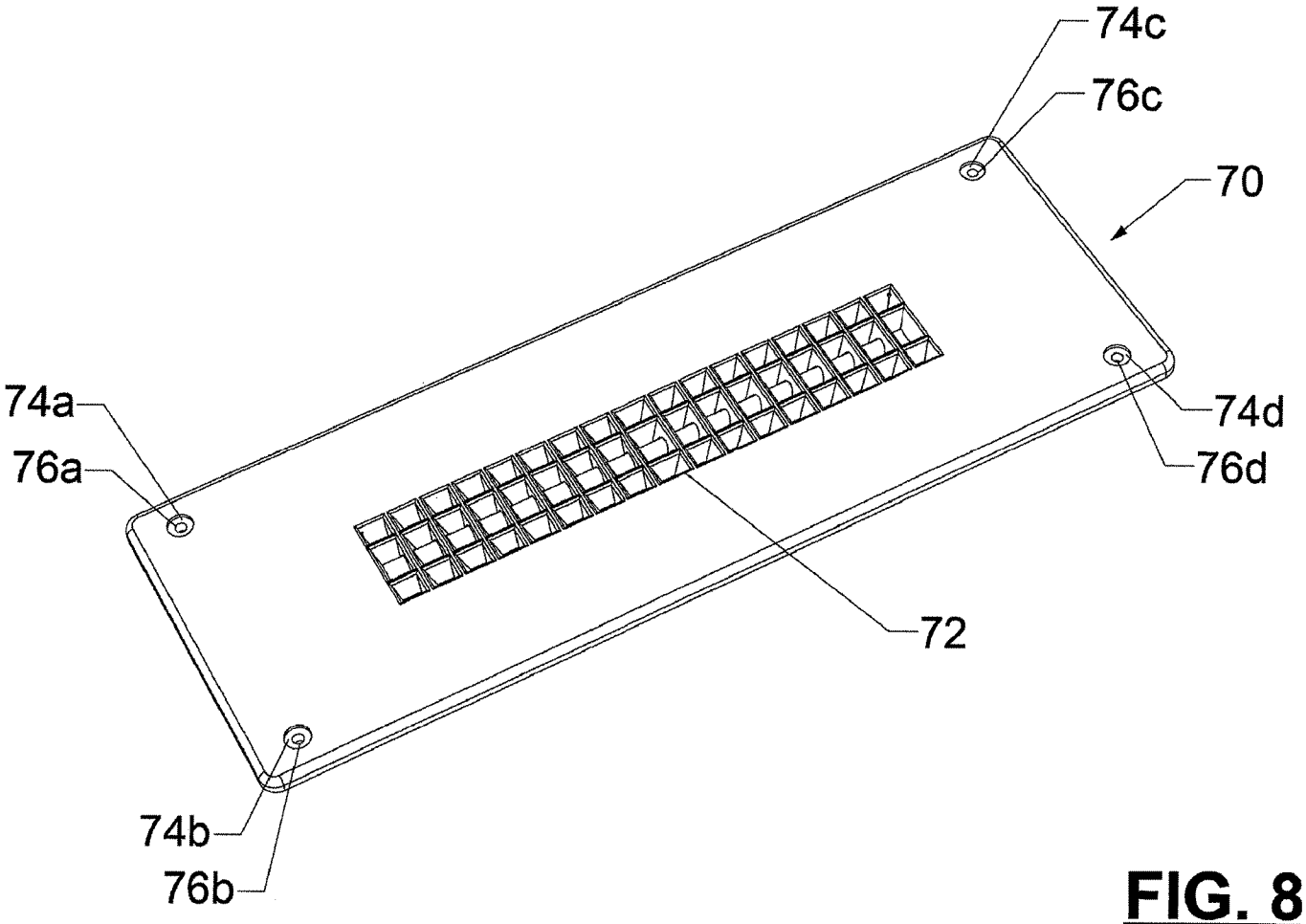
FIG. 8 is a top perspective view of the cover plate of FIG. 7.

Referring now to FIGS. 4 to 6, a second embodiment of an improved duct plug 60 is shown. The duct plug 60 is generally similar to the duct plug 10 shown in FIGS. 1 to 3 with the notable exception that the duct plug 60 includes a first frame member 62, a second frame member 64 and a filter member 66 which are substantially rectangular. As best shown in FIG. 5, the first frame member 62 includes a rectangular plate 61 with an opening 63 which is also rectangular in this example but may be other shapes. The second frame member 64 includes a rectangular plate 65 with an opening 67 which is also rectangular in this example but may be other shapes. As shown in FIG. 6, the duct plug 60 is received within a rectangular termination opening 68 of, for example, a heating duct (not shown) in a floor application. The filter member 66 inhibits dust and debris from falling into the duct. However, air from the duct is allowed to pass through the filter member 66 via the opening 63 in the first frame member 62 and the opening 67 in the second frame member 64. Alternatively, a member formed of a non-permeable material may be used in place of the filter member 66 to inhibit air from the duct from flowing into a building space as well as dust and debris from falling into the duct.

Referring now to FIGS. 7 to 10, there is shown a cover plate 70 which is shaped to cover the termination opening 68 when the dust plug 60 is received within the termination opening 68. Alternatively, the cover plate 70 may be used to cover the termination opening 68 without the dust plug 60 being received within the termination opening 68. The cover plate 70 includes a grill 72 which allows air passing through the filter member 66 to flow into the building space. There may be one or more through holes, for example, holes 74*a*, 74*b*, 74*c* and 74*d*, in the cover plate 70, each of which receives a corresponding fastener, for example, screws 76*a*, 76*b*, 76*c* and 76*d*, to secure the cover plate 70 to a floor.

Figure 9:
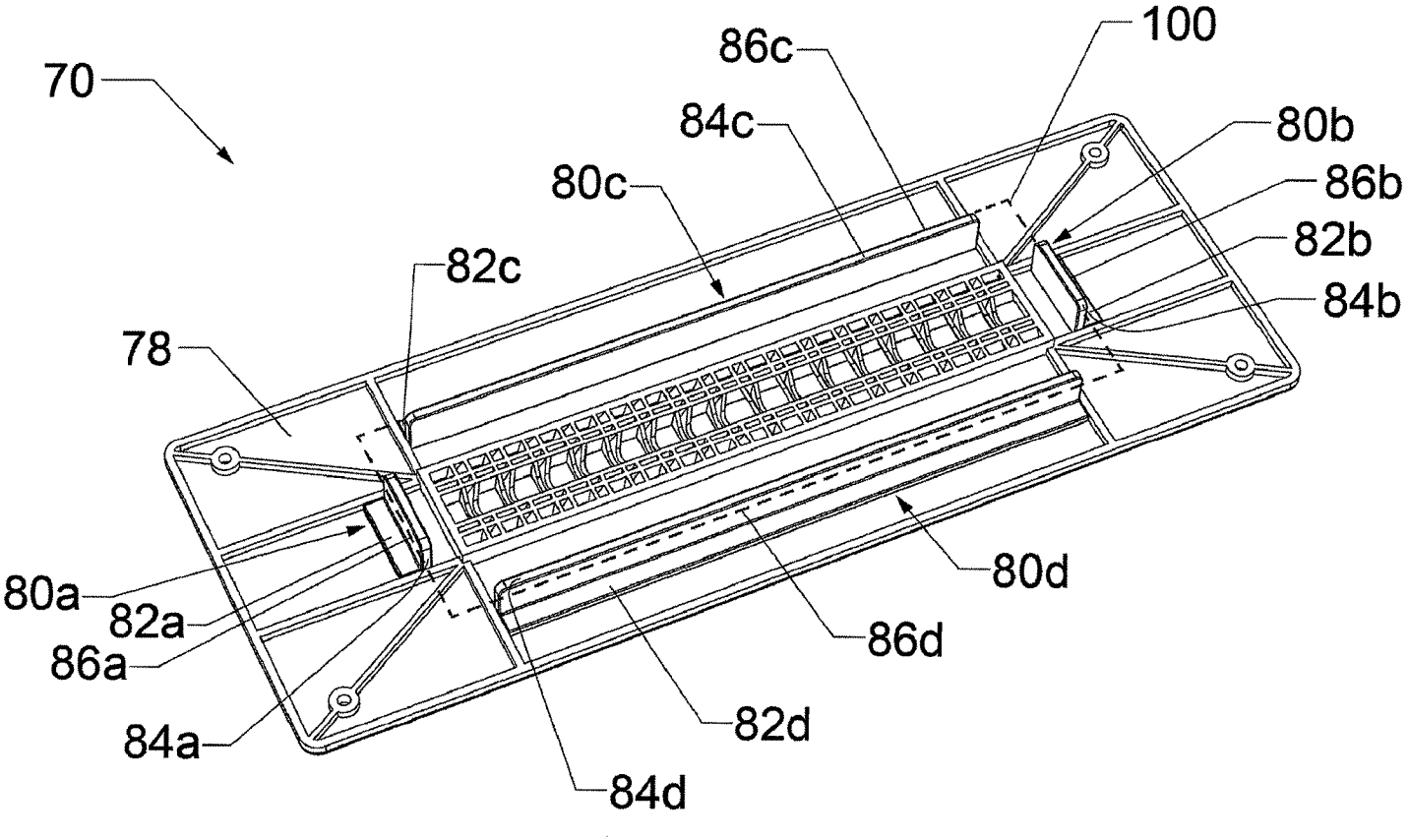
FIG. 9 is a bottom perspective view of the cover plate of FIG. 7.
Figure 10:
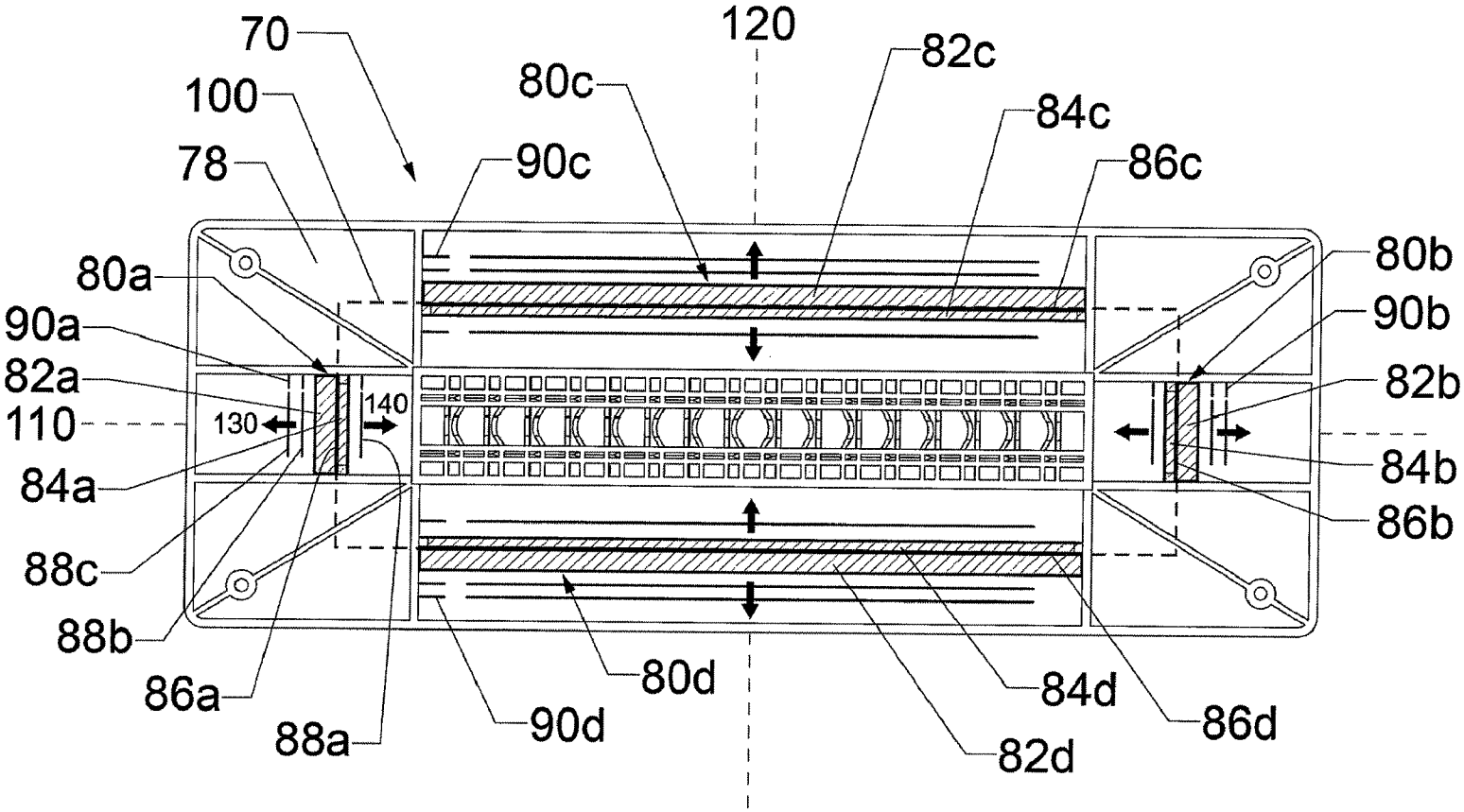
FIG. 10 is a bottom plan view of the cover plate of FIG. 7 showing a range of motion of walls thereof.

As shown in FIGS. 9 and 10, the cover plate 70 includes a plurality of adjustable walls, for example, walls 80*a*, 80*b*, 80*c* and 80*d*, on an underside 78 thereof. The walls 80*a*, 80*b*, 80*c* and 80*d* are L-shaped in this example but may be other shapes. The walls 80*a*, 80*b*, 80*c* and 80*d* have corresponding first wall members 82*a*, 82*b*, 82*c* and 82*d*, and corresponding second wall members 84*a*, 84*b*, 84*c* and 84*d* which are substantially perpendicular to the first wall members 82*a*, 82*b*, 82*c* and 82*d* respectively. Corresponding outer faces 86*a*, 86*b*, 86*c* and 86*d* of the second wall members 84*a*, 84*b*, 84*c* and 84*d* form an inner perimeter 100 of the cover plate 70. The outer faces 86*a*, 86*b*, 86*c* and 86*d* of the second wall members 84*a*, 84*b*, 84*c* and 84*d* frictionally engage interior duct walls 69*a*, 69*b*, 69*c* and 69*d*, shown in FIG. 7, which form a perimeter 71 of the termination opening 68. This ensures that the cover plate 70 is held in place over the termination opening 68.

Referring back to FIG. 10, the walls 80*a* and 80*b* are slidable along a longitudinal axis 110 of the cover plate 70 while the walls 80*c* and 80*d* are slidable along a transverse axis 120 of the cover plate 70 which is substantially perpendicular to the longitudinal axis 110. The underside 78 of the cover plate 70 includes one or more detents, for example, detents 88*a*, 88*b* and 88*c* of the wall 80*a*. The walls and detents are substantially similar in structure and function. Accordingly, only one of the walls 80*a* and its corresponding detents 88*a*, 88*b* and 88*c* are described in detail herein with the understanding that the remaining walls and detents have a substantially similar structure and function in a substantially similar manner.

A user can slide the wall 80*a* along the axis 110 by, for example, applying force in a direction generally indicated by arrow 130 until the first wall member 82*a* of the wall 80*a* abuts against the detent 88*b*. The detent 88*b* inhibits further sliding of the wall 80*a* unless further force is applied to the wall 80*a*. When further force is applied to the wall 80*a*, for example, in the direction indicated by arrow 130, the wall 80*a* slides along the axis 110 until the first wall member 82*a* of the wall 80*a* abuts against the detent 88*c*. This allows the wall 80*a* to be moved stepwise in the direction indicated by arrow 130 to increase the inner perimeter 100 of the cover plate 70. Similarly, the user can also slide the wall 80*a* along the axis 110 by applying force in a direction generally indicated by arrow 140, which is opposite the direction indicated by arrow 130, until the first wall member 82*a* of the wall 80*a* abuts against the detent 88*a*. This allows the wall 80*a* to be moved stepwise in the direction indicated by arrow 140 to decrease the inner perimeter 100 of the cover plate 70. Accordingly, sliding the walls 80*a*, 80*b*, 80*c* and 80*d* stepwise along their respective axes allows the inner perimeter 100 to be increased or decreased so that the outer faces 86*a*, 86*b*, 86*c* and 86*d* of the second wall members 84*a*, 84*b*, 84*c* and 84*d* can frictionally engage interior duct walls of different sized duct openings. There may also be indicia, for example, lines 90*a*, 90*b*, 90*c* and 90*d*, on the underside 78 of the cover plate 70 to indicate sizes of the inner perimeter 100 achieved by sliding the walls 80*a*, 80*b*, 80*c* and 80*d* stepwise against each detent.

It will be understood by a person skilled in the art that the duct plug is shown herein to be circular or rectangular but that the duct plug may be other shapes.

It will be further understood by a person skilled in the art that many of the details provided above are by way of example only, and are not intended to limit the scope of the invention which is to be determined with reference to the following claims.

What is claimed is:

1. A duct plug for use with a duct opening of a heating, ventilation or air conditioning duct system, the duct plug comprising:

a first frame member having an inner face and an outer face;

a second frame member having an inner face and an outer face;

an air-permeable filter member disposed between the inner face of the first frame member and the inner face of the second frame member, the filter member extending outwardly beyond the first frame member and the second frame member; and a handle extending from at least one of the outer face of the first frame member and the outer face of the second frame member;

wherein the first frame member is releasably coupled to the second frame member by a fastener which extends through the filter member.

2. The duct plug as claimed in claim 1 wherein the fastener includes a shaft extending from the first frame member, the shaft extending through a filter aperture in the filter member and being received by a frame aperture in the second frame member.

3. The duct plug as claimed in claim 1 wherein the first frame member and the second frame member each include an annular plate with a central opening.

4. The duct plug as claimed in claim 3 wherein the filter member is disc-shaped.

5. The duct plug as claimed in claim 1 wherein the first frame member, the second frame member and the filter member are rectangular.

6. The duct plug as claimed in claim 1 further including a plurality of circumferentially spaced-apart teeth extending from the inner face of at least one of the frame members and into the filter member.

7. The duct plug as claimed in claim 1 wherein the filter member is an air-permeable plastic foam.

8. A duct plug for use with a duct opening of a heating, ventilation or air conditioning duct system, the duct plug comprising:

a first frame member having an inner face and an outer face;

a second frame member having an inner face and an outer face;

an air-permeable filter member disposed between the inner face of the first frame member and the inner face of the second frame member, the filter member extending outwardly beyond at least one of the frame members; and a handle extending from at least one of the outer face of the first frame member and the outer face of the second frame member;

wherein the first frame member includes a shaft extending through a filter aperture in the filter member, the shaft being received by a frame aperture in the second frame member to releasably couple the first frame member to the second frame member.

* * * * *